US007617640B2

(12) United States Patent
Bradley

(10) Patent No.: US 7,617,640 B2
(45) Date of Patent: Nov. 17, 2009

(54) INSULATED CONCRETE FORM METHOD AND SYSTEM

(76) Inventor: Sabina Bradley, 506 Tiberon Cove Rd., Longwood, FL (US) 32750

( * ) Notice: Subject to any disclaimer, the term of this patent is extended or adjusted under 35 U.S.C. 154(b) by 0 days.

(21) Appl. No.: 12/047,598

(22) Filed: Mar. 13, 2008

(65) Prior Publication Data

US 2009/0229205 A1 Sep. 17, 2009

(51) Int. Cl.

| | |
|---|---|
| ***E04C 1/00*** | (2006.01) |
| ***E04G 21/26*** | (2006.01) |
| ***E04B 2/00*** | (2006.01) |
| ***E04G 11/06*** | (2006.01) |

(52) U.S. Cl. ..... 52/127.2; 52/309.9; 52/309.12; 52/425; 249/33

(58) Field of Classification Search ..... 52/309.9, 52/309.11, 309.12, 127.2, 426, 425; 249/219.2, 249/33; 248/679

See application file for complete search history.

(56) References Cited

U.S. PATENT DOCUMENTS

| | | | | |
|---|---|---|---|---|
| 3,601,356 | A * | 8/1971 | Yurick | 249/92 |
| 3,748,806 | A * | 7/1973 | Talandis | 52/404.1 |
| 4,068,427 | A * | 1/1978 | Camardo | 52/127.2 |
| 5,622,021 | A * | 4/1997 | Bookout | 52/582.1 |
| 5,836,126 | A * | 11/1998 | Harkenrider et al. | 52/410 |
| 6,539,677 | B1 * | 4/2003 | Lanka | 52/127.2 |
| 6,739,102 | B2 * | 5/2004 | Roy, Sr. | 52/294 |
| 7,254,925 | B2 * | 8/2007 | Stefanutti et al. | 52/309.9 |

* cited by examiner

*Primary Examiner*—Robert J Canfield
*Assistant Examiner*—Babajide Demuren
(74) *Attorney, Agent, or Firm*—McKinney Law, PLLC

(57) ABSTRACT

An insulated concrete form system having a pair of bottom U-shaped channels secured to a concrete slab that serve as a footprint for a concrete wall. Exterior and interior foam sheets are aligned within the bottom U-shaped channels that define the wall. Top U-shaped channels are slipped over a top edge of the foam sheets. A plurality of strongbacks are used to provide structural support for the foam sheets during a concrete pour of the wall. The strongbacks each have a pair of hangers adapted to be secured over the top U-shaped channels to secure the strongbacks to the foam sheets. A top wall spacer is used to join a strongback on one side of the wall cavity to a strongback on a second side of the cavity to resist pressure exerted outward on the foam sheets during a concrete pour to form the wall.

18 Claims, 7 Drawing Sheets

INSULATED CONCRETE FORM METHOD AND SYSTEM

BACKGROUND OF THE INVENTION

1. Field of the Invention

The present invention relates generally to the construction of free-standing residential structures, and more specifically to a novel insulated concrete form method and system.

2. Description of the Prior Art

The prior art concrete form systems require the use of numerous ties to secure the forms in place. The ties create undesirable obstacles within the wall cavity during construction thereby increasing the difficulty and complexity in the installation of conduits, window and door framing as there is not a clear space between the forms. Moreover, the ties are susceptible to failure and breakage thereby reducing the strength of the system. Other types of prior art forming systems require the use of complicated bracing systems that are costly, cumbersome and time-consuming to assemble and disassemble.

Accordingly, what is needed in the art is an insulated concrete form system that reduces or eliminates the use of ties to create a clear work space between the forms for installation of windows, doors and conduits.

Another shortcoming of the prior art is that the insulated concrete forms are typically higher priced, result in a poor surface appearance and are flimsy. These prior art systems consist of small foam blocks that are either pre-formed or separate panels connected with expensive plastic or metal ties.

Yet another shortcoming in the art is a method and system to utilize forms that are easy to assemble and disassemble.

Another need in the art is for an insulated concrete system that is adjustable to different widths of walls and uses the same components to construct any size wall.

There is also a need in the art for a wall system that can withstand severe wind loads, and increased resistance to fire and structural failure.

Notwithstanding the existence of such prior art insulated concrete form systems, there is a need for an improved insulated concrete form system that is easy to assemble on site.

It is, therefore, to the effective resolution of the aforementioned problems and shortcomings of the prior art that the present invention is directed.

However, in view of the prior art at the time the present invention was made, it was not obvious to those of ordinary skill in the pertinent art how the identified needs could be fulfilled.

SUMMARY OF THE INVENTION

This invention is an insulated concrete form system comprising a pair of bottom U-shaped channels, a pair of top U-shaped channels, interior foam sheets, exterior foam sheets, exterior strongbacks, interior strongbacks, and top wall spacers. The pair of bottom U-shaped channels are secured to a concrete slab and serve as the footprint for the wall. The bottom U-shaped channels are parallel to one another and spaced apart in accordance with the design specifications. The bottom edge of the exterior foam sheet is aligned within the bottom U-shaped channel that defines the exterior surface of the wall and the top U-shaped channel is secured to the top edge of the exterior foam sheet. Similarly, the bottom edge of the interior foam sheet is aligned with the bottom U-shaped channel that defines the interior surface of the wall and the top U-shaped channel is secured to the top edge of the interior foam sheet. Accordingly, a relatively narrow wall cavity is formed between the interior and exterior foam sheets pursuant to the design width of a wall. The wall cavity provides an unobstructed area for construction elements and to install framing for windows and doors, electrical boxes, conduits, dryer tubes, vacuum tubes, wire mesh sheets, rebar or shelves. The wall cavity can be straight or curved depending on the design.

The pair of top U-shaped channels are secured together using an interior strongback and an opposing exterior strongback. The top of each strongback hooks over the top U-shaped channels and the bottom of each strongback has a lip that slips inside the bottom U-shaped channels to secure it in place. The opposing strongbacks are adjacent to the outer surface of the foam sheets and provide the structural support necessary to withstand the pressure from pouring concrete within the wall cavity. Once the concrete has set, the strongbacks are removed and can be re-used. The foam sheets remain in place providing insulation and a moisture barrier to the concrete walls. The exterior of foam sheets can be used as a base for the installation of stucco, lap siding or brick. The interior of the foam sheets can be covered with typical building materials such as drywall or plaster.

Once the concrete is poured, the foam covering window and door openings can be removed or remain in place until the windows and doors are ready for installation. Pre-cast lintels and headers are not needed above openings since the poured in place concrete wall carries the structural load. If the design requires horizontal rebar, a removable tie can be used to hold the rebar at the proper elevation.

It is therefore an object of the present invention to provide for an improvement that overcomes the aforementioned inadequacies of the prior art and provides a significant contribution to the advancement of insulated concrete form systems.

Both the foregoing general description and the following detailed description are explanatory and are not restrictive of the invention as claimed. The accompanying drawings, which are incorporated in and constitute part of the specification, illustrate embodiments of the present invention and together with the general description, serve to explain principles of the present invention.

These and other important objects, advantages, and features of the invention will become clear as this description proceeds.

The invention accordingly comprises the features of construction, combination of elements, and arrangement of parts that will be exemplified in the description set forth hereinafter.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
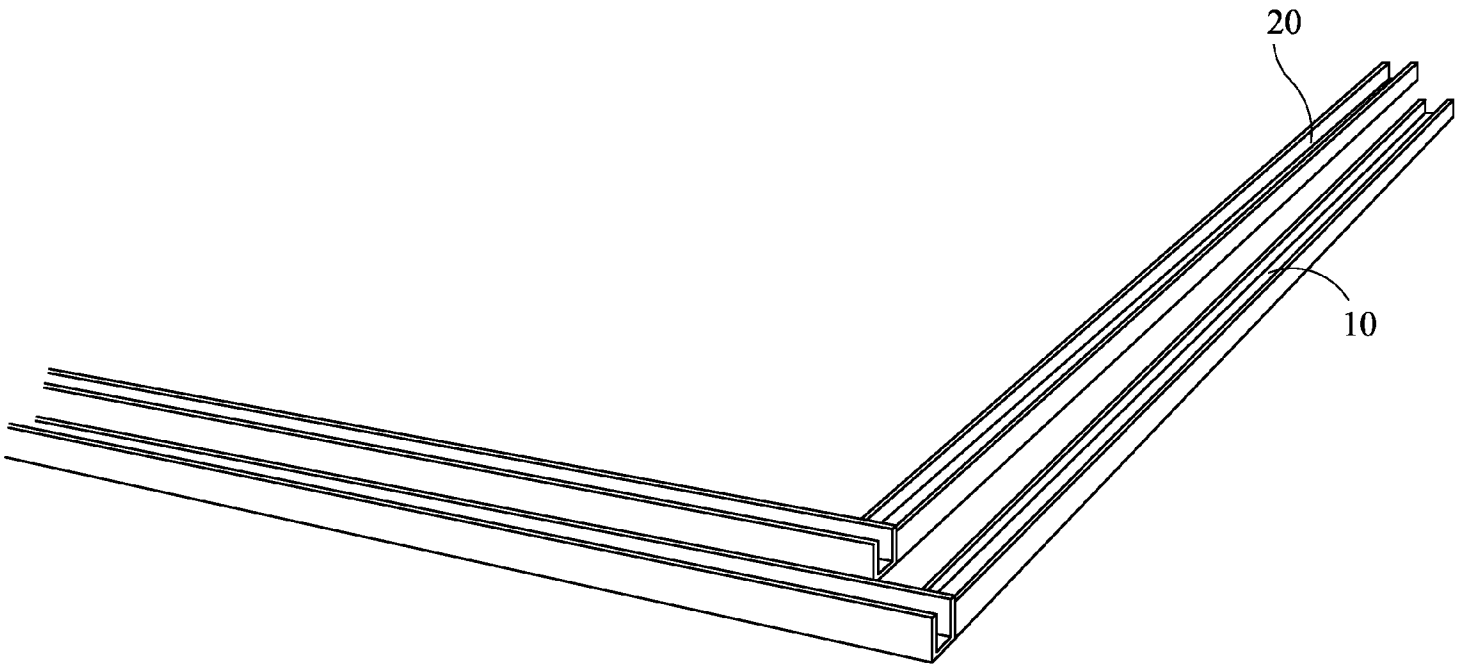
FIG. 1 is a perspective view of the pair of bottom U-shaped channels installed on a concrete slab.

Referring to FIG. 1 shows the pair of bottom U-shaped channels secured to a concrete floor. An exterior bottom U-shaped channel 10 allows the bottom edge of the exterior foam sheet to be secured therein. The interior bottom U-shaped channel 20 is secured to the concrete slab an appropriate distance to accommodate the design width of the wall. The width can vary from six (6) to twenty (20) inches. The U-shaped channels 10, 20 are fastened to floor slabs using pneumatic nailers.

Figure 2:
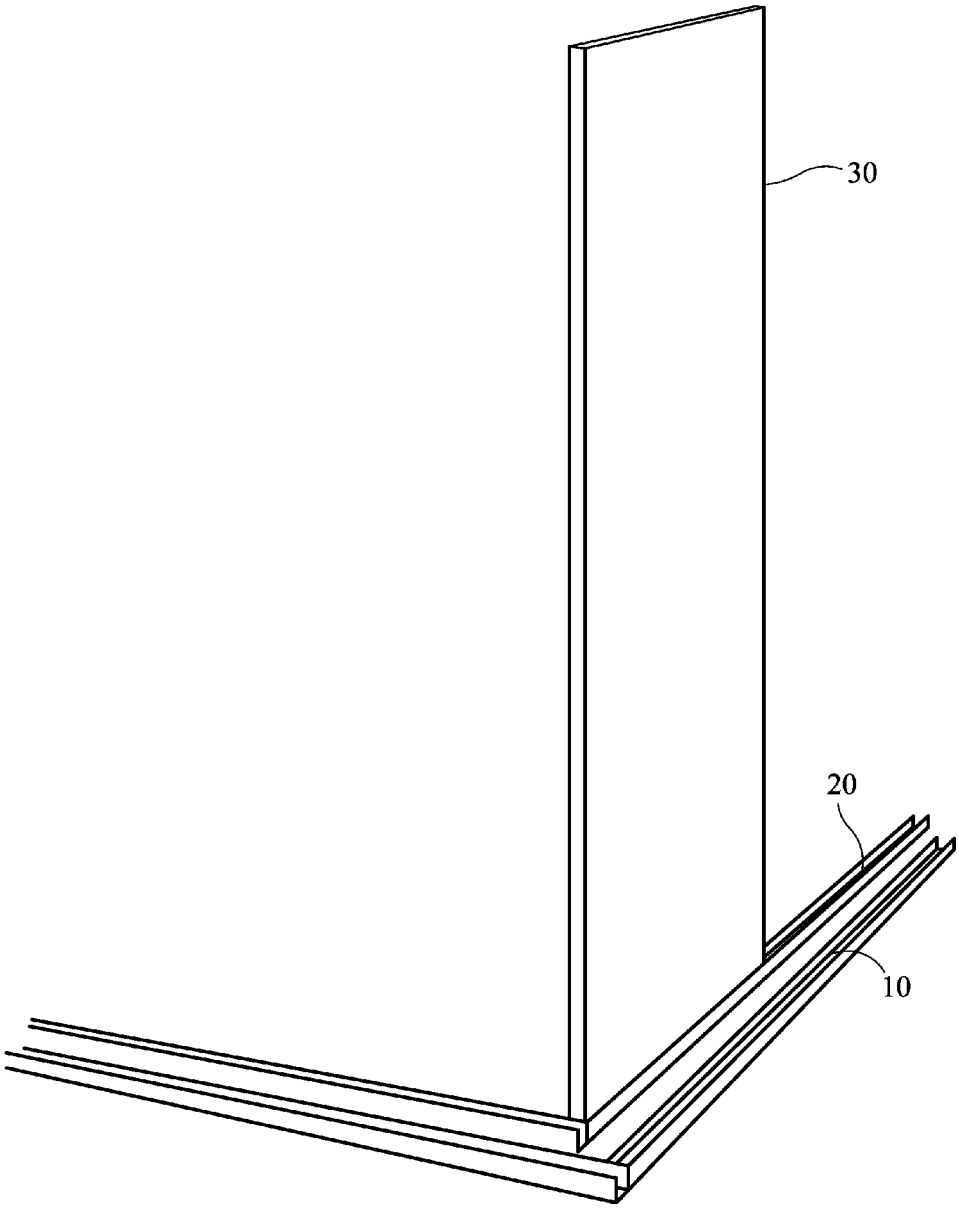
FIG. 2 is a perspective view of an interior foam sheet installed in the bottom U-shaped channel.
Figure 3:
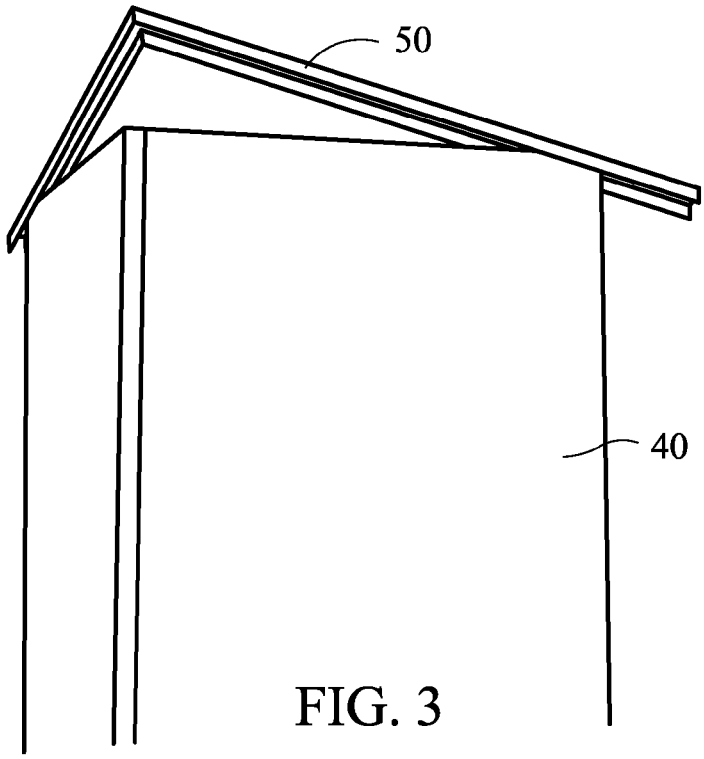
FIG. 3 is a perspective view of the top U-shaped channel installed on the top edge of an exterior foam sheet.

FIG. 2 shows interior foam sheet 30 installed within interior bottom U-shaped channel 20. Once a foam sheet is placed in the bottom U-shaped channel, the top U-shaped channel 50 is placed on the top edge of foam sheet 40 as shown in FIG. 3. Foam sheets 30, 40 vary in size from four (4) feet wide to eight (8), ten (10), twelve (12) or twenty-four (24) feet in length and are made of polystyrene. The thickness of foam sheets 30, 40 vary from one (1), two (2) or four (4) inches and remain with the structure after the concrete is poured. The resulting concrete wall of the present invention provides insulating values of R-20 to R-60. In addition, foam sheets 30, 40 have a waffle-textured surface to increase concrete adhesion on the inner surfaces and to stucco and plaster on the outer surfaces. In alternative embodiments, the outer surface of foam sheet 40 is covered with a fiberglass mesh and a primer coat of stucco.

Figure 4:
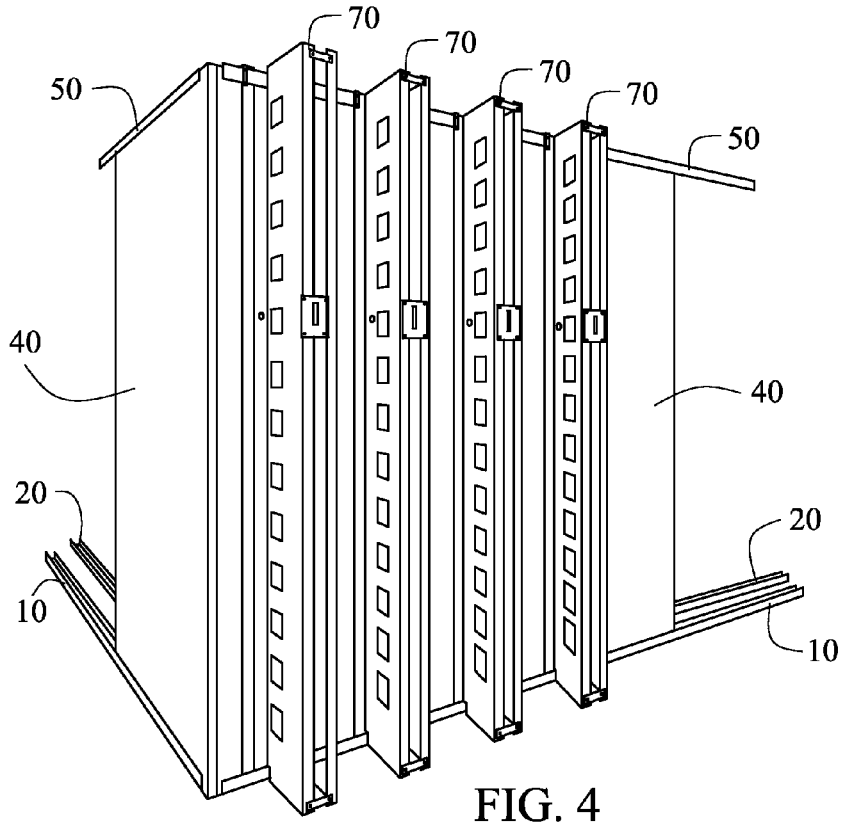
FIG. 4 is a perspective view of strongbacks installed and supporting the exterior foam sheets in accordance with an embodiment of the present invention.

As shown in FIG. 4, a series of strongbacks 70 are secured adjacent to foam sheets 30, 40 that serve as a form for the concrete wall. The strongbacks support the foam sheets 30, 40 from wet concrete pressures. The strongbacks 70 are spaced at 18 to 24 inches on center. The installation of the system includes first attaching bottom channels 10, 20 to the concrete slab. The foam sheets 30, 40 are slid into the bottom channels 10, 20 and the top channels 50, 60 are then placed over the top edge of foam sheets 30, 40. The sequence of the installation begins at the corners of the structure and continues to the center of the wall between the corners. Thus, only the center foam sheet needs to be trimmed during the installation process saving time and reducing waste. The strongbacks 70 are similarly attached beginning at the corner of the structure and moving away from the corners. The bottom of strongback 70 is installed so that a lip of strongback 70 slips in between foam sheet 30, 40 and a flange of bottom U-shaped channel 10, 20. This secures the strongback 70 in place. A top wall spacer 110 is used to connect the top portion of the strongbacks 70 at the exterior and interior foam sheets 30, 40 to maintain the proper spacing for the wall thickness. No additional screws or ties are needed as part of the form system. Bracing bars (not shown) can be placed around corners to adjust walls for straightness and for long wall runs. For very thick walls, 2×4 lumber or metal channels can fit horizontally into any of the side openings of the strongbacks 70 for additional support.

Figure 5:
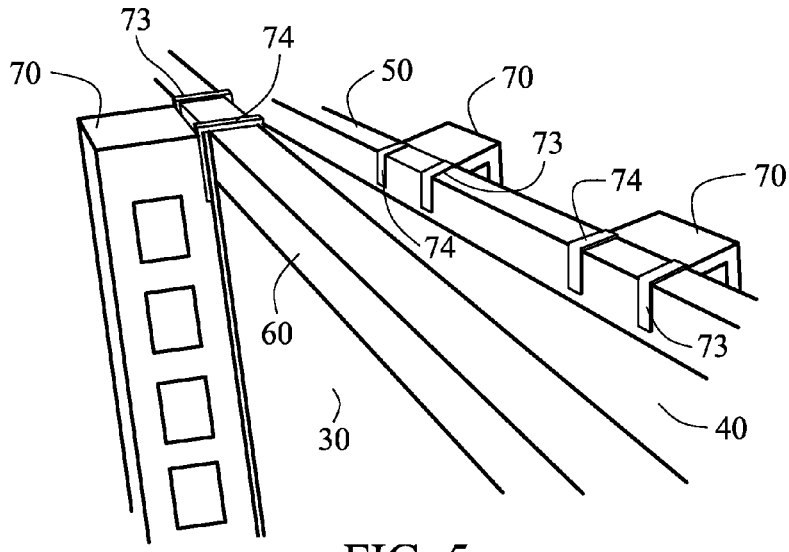
FIG. 5 is a view of the pair of top U-shaped channels installed on the interior and exterior foam sheets and strongbacks secured to the top-U-shaped channels.

Referring now to FIG. 5, the pair of top U-shaped channels 50, 60 are shown installed on the interior and exterior foam sheets 30, 40 and a wall cavity is formed between the foam sheets. Each strongback 70 has a pair of hangers 73, 74 on either side for securing over top channels 50, 60. Hangers 73, 74 are secured to lateral flanges 78, 79 of strongback 70.

Figure 9:
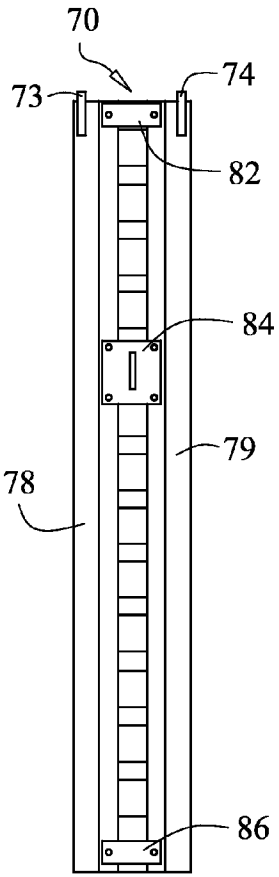
FIG. 9 is a rear view of a strongback in accordance with an embodiment of the present invention.
Figure 8:
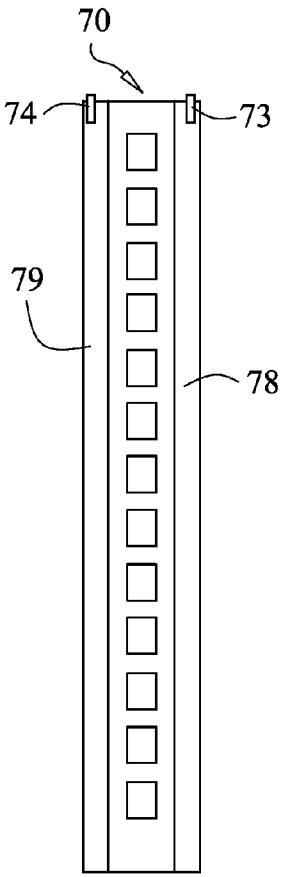
FIG. 8 is a front view of a strongback in accordance with an embodiment of the present invention.
Figure 7:
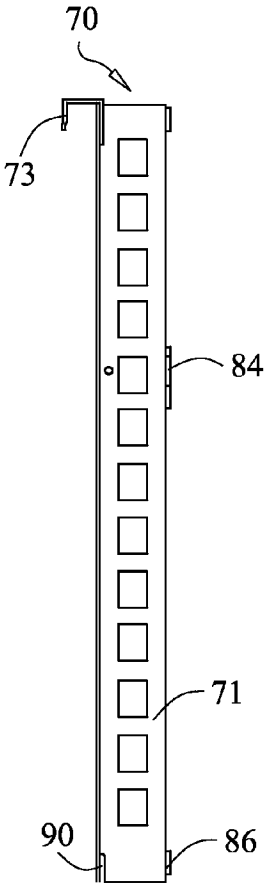
FIG. 7 is a side view of a strongback in accordance with an embodiment of the present invention.
Figure 6:
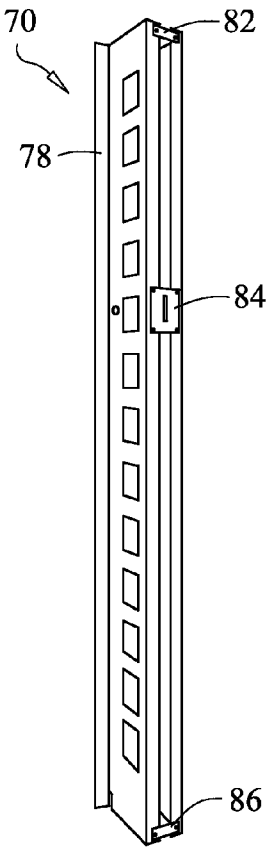
FIG. 6 is a rear perspective view of a strongback in accordance with an embodiment of the present invention.

As shown in FIGS. 6-9, an upper crossmember 82 and lower crossmember 86 provide structural support to strongback 70. Scaffold bracket 84 is disposed between upper crossmember 82 and lower crossmember 86 and is adapted to receive a scaffold support. A scaffold aperture may be provided so that a scaffold-locking pin can be slipped through to secure scaffold support within strongback 70. Scaffold bracket also provides structural support to strongback 70. Referring now to FIG. 7 showing a side view of strongback 70, bottom lip 90 of strongback 70 is adapted to slide in between foam sheet 30, 40 and a flange of bottom U-shaped channel 10, 20. FIG. 8 is a front view of strongback 70 showing the pair of lateral flanges 78, 79 that provide additional surface area to strongback 70 to increase the structural stability of the forming system. FIG. 9 is a rear view of strongback 70 showing the lateral flanges 78, 79 and hangers 73, 74 attached thereto.

Figure 10:
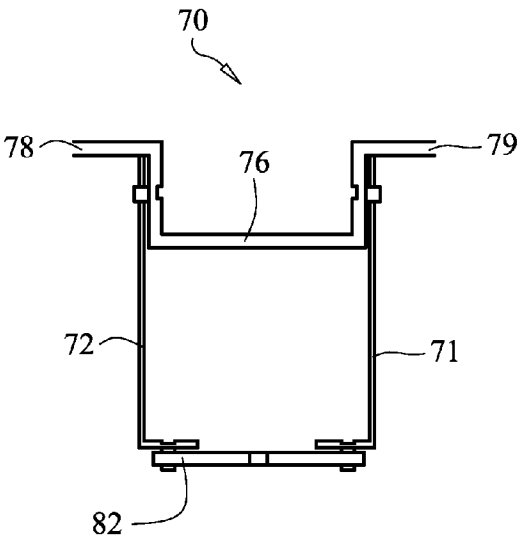
FIG. 10 is a top of a strongback in accordance with an embodiment of the present invention.

Referring now to FIG. 10, a top view of strongback 70 is shown wherein lateral flanges 78, 79 are joined together by center strut 76. Side members 71, 72 are perpendicular to lateral flanges 78, 79 and center strut 76 overlaps an inner wall portion of each side member 71, 72 to provide a mounting surface. Upper crossmember 82 serves to join side members 71, 72 together at an equidistant spacing so that strongback 70 forms a box-like structure in cross-section.

Figure 11:
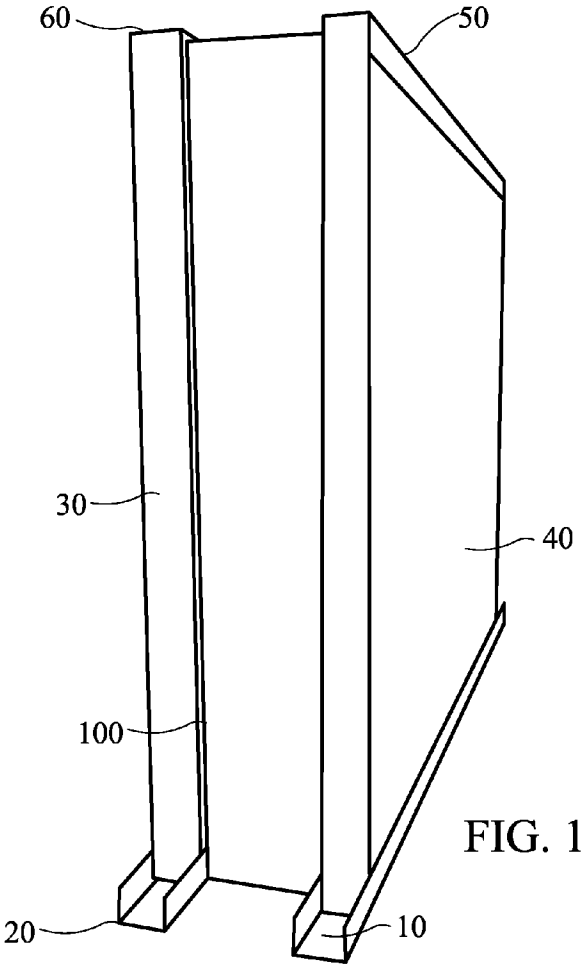
FIG. 11 is a perspective view of a concrete wall formed using the insulated concrete form system of the present invention.

FIG. 11 shows concrete wall 100 with the foam sheets 30, 40 and the strongbacks removed. Pair of top U-shaped channels 50, 60 and bottom U-shaped channels 10, 20 remain in place, although top channels 50, 60 can be removed in some scenarios depending on the concrete pour height. In alternative embodiments, concrete wall 100 contains fiber-reinforced additives to increase insulation and structural integrity.

Figure 12:
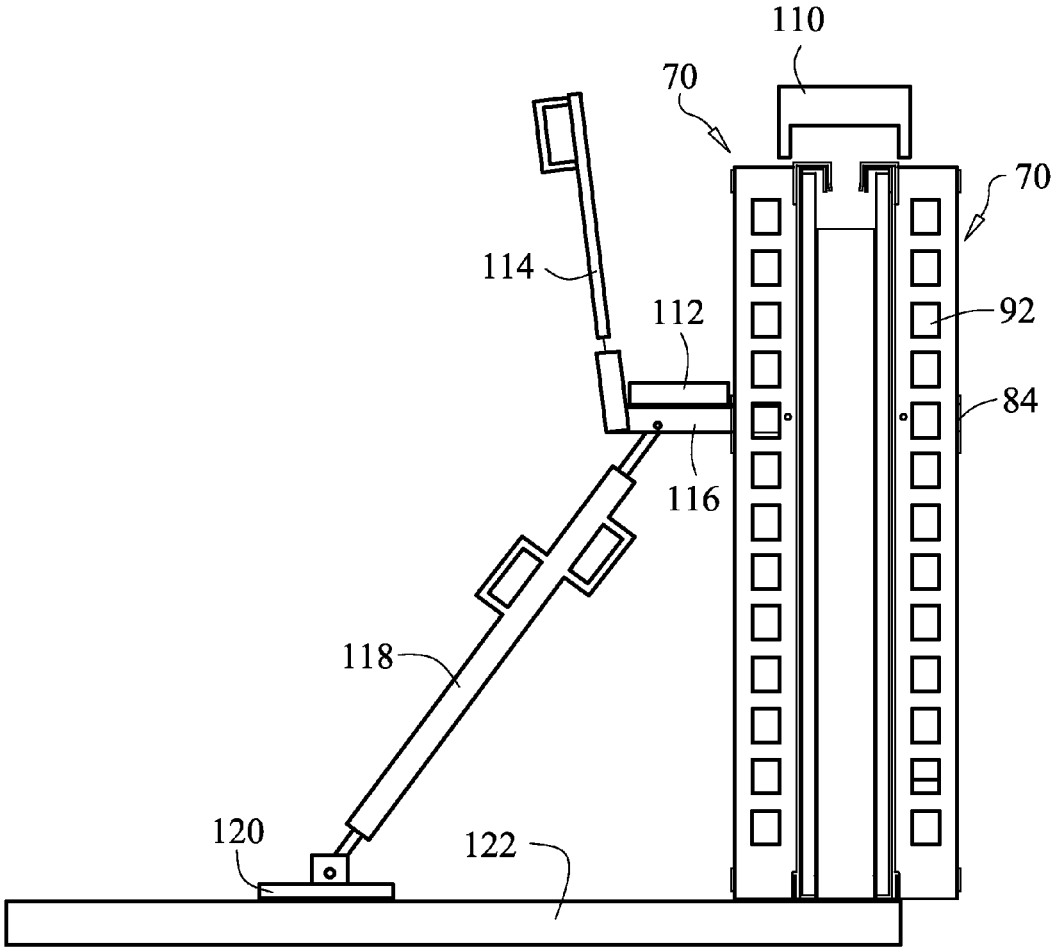
FIG. 12 is a side view of the elements of the insulated concrete form system including a scaffold support and wall spacer in accordance with an embodiment of the present invention.

Referring now to FIG. 12, top wall spacer 110 is used to join the top portions of two strongbacks 70 to resist pressure exerted outward during a concrete pour. A scaffold member 112 is inserted in scaffold bracket 84 at the inner side of the forming system. A first end of support member 118 is secured to scaffold member 112 on the underside. A second end of support member 118 is secured to slab 122 using a pivotal base 120. A second scaffold member 116 is spaced an adequate distance from first scaffold member so that plank 112 spans between the two scaffold members. Accordingly, a worker can stand and walk along plank 112 to perform additional work. Railing 114 is inserted into scaffold member 116 to provide a safe working environment. Scaffold member 116 can be used on the interior or exterior side of the wall. Lumber or metal channels can fit horizontally through any of the side openings 92 of the strongbacks 70 for additional support.

Electrical conduits can be installed with the present invention by implementing the steps described below. First, join two electrical outlet boxes together and secure a conduit to the rear electrical box using appropriate connectors. Next, secure a length of cord to the inside of the electrical box and stuff the cord inside of the box for later use. Trace the back of the electrical box onto the exterior foam surface at the proper location so that the conduit with the boxes attached can be lowered from the top of the wall cavity down to the desired opening. Attach the cord directly to the closest strongback to prevent it from slipping back into the cavity during concrete placement. Additional boxes can be added to the same conduit for light switches or additional electrical outlets. Plumbing and vacuum systems can also be installed using a similar method.

The particular embodiments disclosed above and in the drawings are illustrative only, as the invention may be modified and practiced in different but equivalent manners apparent to those skilled in the art having the benefit of the teachings herein. Furthermore, no limitations are intended to the details of construction or design herein shown. It is therefore evident that the particular embodiments disclosed above may be altered or modified and all such variations are considered within the scope and spirit of the invention.

Now that the invention has been described,

What is claimed is:

1. An insulated concrete form system comprising:

a pair of bottom U-shaped channels that are secured to a concrete slab and serve as a footprint for a concrete wall, wherein the pair of bottom U-shaped channels are parallel to one another and spaced apart in accordance with design specifications;

an exterior foam sheet, wherein a bottom edge of the exterior foam sheet is aligned within one of the bottom U-shaped channels that defines an exterior surface of the wall;

an interior foam sheet, wherein a bottom edge of the interior foam sheet is aligned with one of the bottom U-shaped channels that defines an interior surface of the wall;

an exterior top U-shaped channel is secured to a top edge of the exterior foam sheet;

an interior top U-shaped channel is secured to a top edge of the interior foam sheet;

a plurality of strongbacks each having a pair of elongated side members equidistantly spaced apart by a center strut, wherein the side members are perpendicular to a pair of lateral flanges disposed about a periphery of the side members; the plurality of strongbacks each further comprising a pair of hangers adapted to be secured over the interior top U-shaped channel and exterior top U-shaped channel; and an exterior strongback of the plurality of strongbacks is adapted to support an exterior surface of the exterior foam sheet and an interior strongback of the plurality of strongbacks is adapted to support an exterior surface of the interior foam sheet, wherein the plurality of strongbacks each further comprising a lip adapted to slip in between the exterior foam sheet or the interior foam sheet and a flange of the bottom U-shaped channel so that a lower portion of each strongback is secured in place.

2. The insulated concrete form system of claim 1, wherein each strongback forms a box-like structure in cross-section.

3. The insulated concrete form system of claim 2, wherein the plurality of strongbacks each further comprising an upper crossmember and lower crossmember that provide structural support.

4. The insulated concrete form system of claim 3, wherein the plurality of strongbacks each further comprising a scaffold bracket disposed between the upper crossmember and the lower crossmember and is adapted to receive a scaffold support.

5. The insulated concrete form system of claim 1, further comprising a top wall spacer adapted to span over a wall cavity formed by the interior foam sheet and the exterior foam sheet and to join a strongback on a first side of the cavity to a strongback on a second side of the cavity to resist pressure exerted outward on the interior foam sheet and the exterior foam sheet during a concrete pour.

6. The insulated concrete form system of claim 5, wherein the wall cavity provides an unobstructed area for construction elements and is adapted to be straight or curved to form the pre-selected shape of a wall.

7. The insulated concrete form system of claim 6, further comprising a first scaffold member secured to a strongback of the plurality of strong backs using a scaffold bracket.

8. The insulated concrete form system of claim 7, further comprising a support member wherein a first end of the support member is secured to the first scaffold member on an underside and a second end of the support member is secured to a foundation slab using a pivotal base so that the first scaffold member is supported in a horizontal orientation.

9. The insulated concrete form system of claim 8, further comprising a second scaffold member spaced an adequate distance from the first scaffold member so that a scaffold plank spans between the first and the second scaffold members for a worker to stand and walk along the plank to perform work.

10. The insulated concrete form system of claim 9, further comprising a railing adapted for insertion into the first and the second scaffold member to provide a safe working environment to workers.

11. An insulated concrete form method, comprising:

providing a pair of bottom U-shaped channels that are secured to a concrete slab and serve as a footprint for a concrete wall, wherein the pair of bottom U-shaped channels are parallel to one another and spaced apart in accordance with design specifications;

providing an exterior foam sheet, wherein a bottom edge of the exterior foam sheet is aligned within one of the bottom U-shaped channels that defines an exterior surface of the wall;

providing an interior foam sheet, wherein a bottom edge of the interior foam sheet is aligned with one of the bottom U-shaped channels that defines an interior surface of the wall;

providing an exterior top U-shaped channel is secured to a top edge of the exterior foam sheet;

providing an interior top U-shaped channel is secured to a top edge of the interior foam sheet;

providing a plurality of strongbacks each having a pair of elongated side members equidistantly spaced apart by a center strut, wherein the side members are perpendicular to a pair of lateral flanges disposed about a periphery of the side members; the plurality of strongbacks each further comprising a pair of hangers adapted to be secured over the interior top U-shaped channel and exterior top U-shaped channel; and providing an exterior strongback of the plurality of strongbacks is adapted to support an exterior surface of the exterior foam sheet and an interior strongback of the plurality of strongbacks is adapted to support an exterior surface of the interior foam sheet, wherein the plurality of strongbacks each further comprising a lip adapted to slip in between the exterior foam sheet or interior foam sheet and a flange of the bottom U-shaped channel so that a lower portion of each strongback is secured in place.

12. An insulated concrete form method of claim 11, wherein each strongback forms a box-like structure in cross-section.

13. An insulated concrete form method of claim 12, wherein the plurality of strongbacks each further comprising an upper crossmember and lower crossmember that provide structural support.

14. An insulated concrete form method of claim 13, wherein the plurality of strongbacks each further comprising a scaffold bracket disposed between the upper crossmember and the lower crossmember and is adapted to receive a scaffold support.

15. An insulated concrete form method of claim 14, further comprising providing a top wall spacer adapted to span over a wall cavity formed by the interior foam sheet and the exterior foam sheet and to join a strongback on a first side of the cavity to a strongback on a second side of the cavity to resist pressure exerted outward on the interior foam sheet and the exterior foam sheet during a concrete pour.

16. An insulated concrete form method of claim 11, wherein the wall cavity provides an unobstructed area for construction elements and is adapted to be straight or curved to form the pre-selected shape of a wall.

17. An insulated concrete form method of claim 15, further comprising providing a scaffold member secured to a strongback of the plurality of strong backs using a scaffold bracket.

18. An insulated concrete form method of claim 17, further comprising providing a support member wherein a first end of the support member is secured to the scaffold member on an underside and a second end of the support member is secured to a foundation slab using a pivotal base so that the scaffold member is supported in a horizontal orientation.

* * * * *